United States Patent [19]

Greenberger

[11] Patent Number: 4,577,482

[45] Date of Patent: Mar. 25, 1986

[54] METHOD AND APPARATUS FOR TREATING WORK ROLLS IN A ROLLING MILL

[75] Inventor: Joseph I. Greenberger, Pittsburgh, Pa.

[73] Assignee: Wean United, Inc., Pittsburgh, Pa.

[21] Appl. No.: 621,754

[22] Filed: Jun. 18, 1984

[51] Int. Cl.[4] ..... B21B 27/10

[52] U.S. Cl. ..... 72/201; 72/236

[58] Field of Search ..... 72/200, 201, 236; 148/153, 155, 156; 266/111, 113

[56] References Cited

U.S. PATENT DOCUMENTS

| | | | |
|---|---|---|---|
| 3,078,747 | 2/1963 | Pearson | 72/236 X |
| 3,357,224 | 12/1967 | Muller | 72/201 |
| 3,410,734 | 11/1968 | Taylor | 266/113 X |
| 3,856,281 | 12/1974 | Bertolotti et al. | 266/113 X |
| 4,076,222 | 2/1978 | Schaming | 266/111 |
| 4,403,492 | 9/1983 | Hope | 72/201 |

FOREIGN PATENT DOCUMENTS

| | | | |
|---|---|---|---|
| 1924319 | 11/1970 | Fed. Rep. of Germany | 72/201 |
| 2414445 | 10/1974 | Fed. Rep. of Germany | 72/201 |
| 2096490 | 10/1982 | United Kingdom | 239/455 |

*Primary Examiner*—E. Michael Combs

*Attorney, Agent, or Firm*—Daniel Patch; Suzanne Kikel

[57] ABSTRACT

A header for applying a low pressure, non-turbulent, coherent curtain wall of coolant of a substantial uniform extent and thickness transversely across the rolling surface of a work roll of a hot rolling mill or the like, which curtain wall in cross-section is in the form of the uniform concentric enveloping camber of a portion of a roll barrel. The placement of the applied wall of coolant is controlled so that the built-up heat in each succeeding work roll portion leaving contact either with the hot material being rolled or its associated back-up roll in a multi-high mill is substantially and uniformly removed, and optimized cooling thereof is achieved. An adjustable discharge slot which may be tapered to discharge the curtain wall across the length of the roll's camber in a manner to control cooling of the work roll from end to end, i.e. the cooling rate of the length of a roll would have a parabolic curve.

11 Claims, 3 Drawing Figures

METHOD AND APPARATUS FOR TREATING WORK ROLLS IN A ROLLING MILL

BACKGROUND OF THE INVENTION

The present invention relates to the uniform application of a fluid for treatment of a roll in a rolling mill or the like, for example, hot or cold rolling of a strip and more particularly, to employing a header for controlling the placement of the coolant across a transverse portion of the roll used for rolling hot strip to rapidly, substantially, and uniformly remove the heat built-up from successive portions of the roll leaving contact either with the heated material being rolled and/or with an associated back-up roll in a multi-high mill.

Presently, headers for applying coolant to the rolls are generally employed to prevent damage to the surface finish of a roll or to thermally control the crown of a roll of a rolling mill. Efficient cooling in the rolling system particularly with regard to the work rolls has several advantages, such as: greater thermal stability; increased life of the roll and wearing thereof, and other mill components; better shape control of the product being rolled; and the reducing of the rate and severity of the surface failure of the work roll which failure is due to thermal fatigue.

Several types of headers are known in the art, such as those employing spray nozzles as disclosed in U.S. Pat. Nos. 3,994,151 and 4,247,047, or a series of discharge slots as disclosed in U.S. Pat. No. 2,811,059. The spray nozzles of the first two U.S. patents deliver high pressure, high volume coolant which then fans out overlapping with the streams of an adjacent nozzle. This overlapping condition results in a non-uniform cooling of the rolling surface and furthermore, the impingement of the sprays against the roll surface is so great that the coolant drops are caused to rebound before meaningful cooling can even occur. In some forms of this type, the sprays are moved further away from the roll surface in an attempt to alleviate the foregoing problems, but this creates a distance between the adjacent streams of the sprays which frequently happens in the first mentioned form due to the nozzles becoming clogged, and therefore, a section of the roll does not receive any coolant.

U.S. Pat. No. 2,811,059 discloses employing a header having a subdivided slot for discharging coolant under high pressure against the surface of a work roll, the discharge apparatuses being arranged on the entry side of the rolling mill stand very closely located to the work rolls to attempt to cool a roll section prior to its contact with a workpiece.

While employing a series of slots instead of circular opening nozzles, the slots are spaced apart and the fluid is understood to be under relatively high pressure so that not only is the coolant applied on the entry side of the roll, but the construction of the slots, the placement of the header, and the pressure of the fluid will not produce enveloping coverage of the fluid, uniform in extent and thickness over the entire surface of the roll at the most advantageous location to give optimized cooling.

Other problems arise with these high pressure sprays or flows in that the violent rebounding of the coolant molecules causes the grease and oil in the bearings of the rolls to be washed away resulting in damage to the spindles of the rolls.

Apparatuses for applying low pressure, nonturbulent, coherent curtain walls of fluid to a surface for cooling thereof have been disclosed in a patent application for cooling rod, bearing U.S. Ser. No. 529,822 filed Sept. 6, 1983, and in U.S. Pat. No. 4,047,985 issuing on Sept. 13, 1977 for symmetrically cooling the top and bottom surfaces of a strip, both inventions being that of the present inventor, J. I. Greenberger. Also, such apparatuses for cooling strip have been disclosed in U.S. Pat. No. 4,403,492 issuing on Sept. 13, 1983; in U.S. Pat. No. 4,210,288 issuing July 1, 1980; and in recently issued patent application bearing U.S. Ser. No. 367,350 filed Apr. 12, 1982, the inventor being J. C. Dobson and/or Thomas Hope in all three cases. These apparatuses are designed to adapt to the particular environment in which they are used and for a particular product to be cooled and cannot and would not successfully be utilized in the same manner as the present invention.

SUMMARY OF THE PRESENT INVENTION

It is, therefore, an object of the present invention to provide a method, apparatus and arrangement for optimizing the cooling effect of a coolant flow applied against a heated area of a roll surface of the work rolls by creating and applying at the most advantageous location an enveloping fluid of low pressure coolant uninterruptedly across the entire length of the roll, which will be uniform in its extent, and therefore resulting in an overall improvement to the entire rolling system, such as greater thermal stability, greater roll and bearing life, and better shape control of the rolled product.

It is a further object of the present invention to provide a method and apparatus for delivering a non-turbulent, coherent curtain wall of coolant or other medium to a surface of a work roll or the like to uniformly cool or otherwise treat a transverse area of said surface.

It is a still further object of the present invention to provide a method and apparatus for delivering a controlled, coherent curtain wall of coolant to a heated area of a work roll, being that area immediately leaving contact with the work piece or in a similar area with an associated back-up roll in a four high or other multi-high rolling mill, the control of the delivery of the coolant being such that the coolant molecules travel directly and uniformly onto and around the roll surface only, thereby eliminating rebounding and entrance into the roll bearings.

Yet a still further object of the present invention is to provide a coolant discharge apparatus having an adjustable continuous slot which may have a maximum center spaced section and from its center section to each opposite end section, the spacing may gradually decrease into a taper to deliver to the roll surface a non-turbulent, low pressure coherent curtain wall of coolant having a corresponding tapering thickness pattern to the extent that this pattern translates into a parabolic cooling profile for the work roll.

And a further object of the present invention is to provide a coolant header for discharging one or more coherent curtain wall flows of coolant, said header located on both the delivery and entry sides of the rolling stand which header is constructed such that the desired coherent curtain wall flow or flows will envelope a selected portion of the work roll regardless of its distance from the work roll.

BRIEF DESCRIPTION OF THE DRAWINGS

These objects, as well as other novel features and advantages of the present invention, will be better appreciated and understood when the following description is read along with the accompanying drawings of which.

DETAILED DESCRIPTION OF A PREFERRED EMBODIMENT OF THE PRESENT INVENTION

Figure 1:
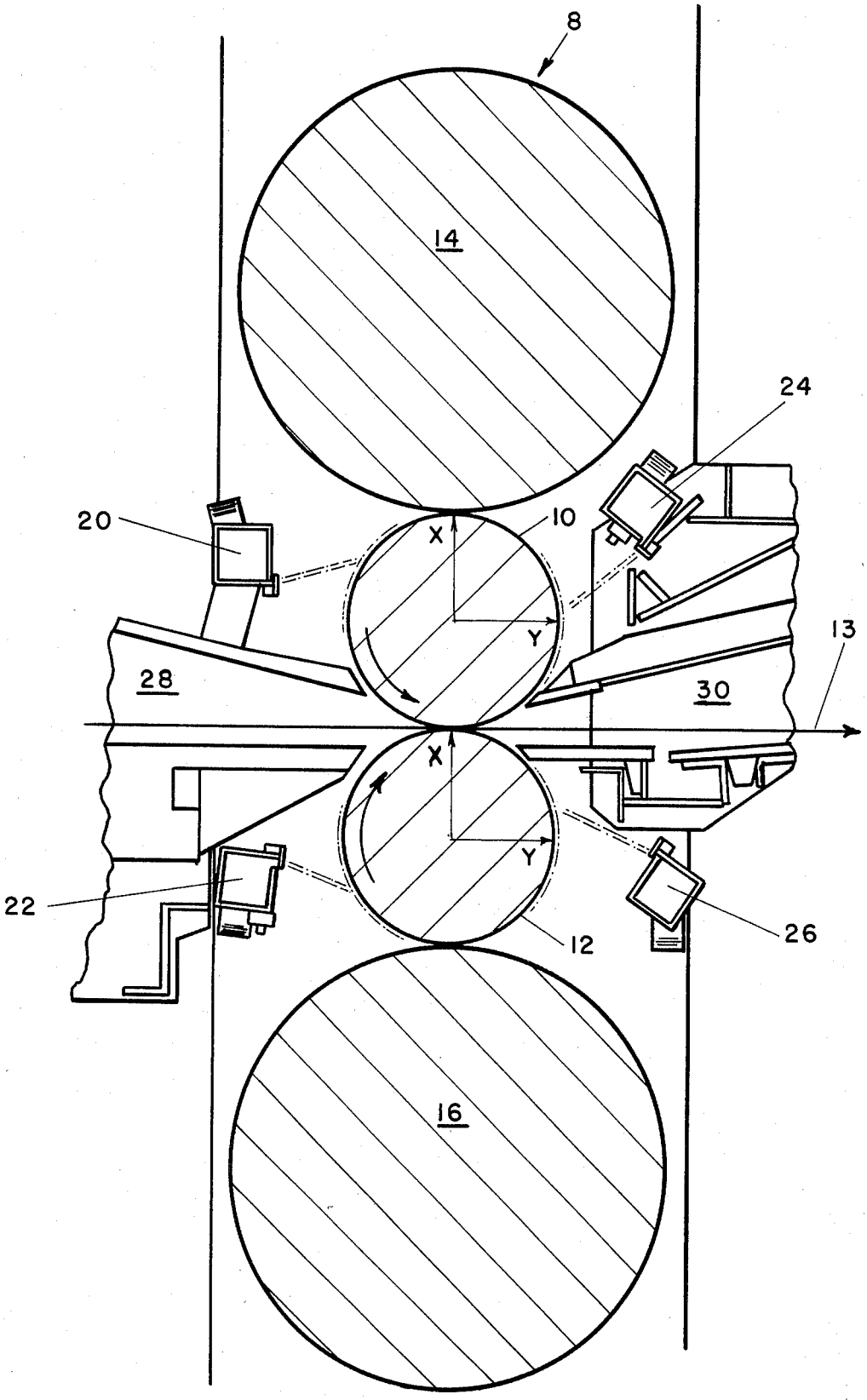
FIG. 1 is an elevational, partly cross sectional view of a portion of four-high rolling mill.

The present invention has particular application in, but is not restricted to, a four high rolling mill stand 8 for the rolling of hot steel strip as shown in FIG. 1. For top and bottom work rolls 10, 12 there is a corresponding top and bottom back-up roll 14, 16, respectively, the latter according to usual practice having a greater diameter than work rolls 10, 12. Strip 13 travels from left to right into the stand 8 of FIG. 1 as indicated by the arrow, which stand in a hot strip rolling mill may be one of several tandem stands of the finishing train or a single stand of a plate mill. In FIG. 1, top and bottom work rolls 10, 12, respectfully, are motor driven to rotate about their horizontal axis in a direction indicated by the arrow on rolls 10, 12.

The higher the rolling speeds, the more important it is for the roll coolant applied to the rolling surface of work rolls 10, 12 be of the proper character, properly located and providing sufficient and uniform coverage and quantity, including such as to remain on rolls 10, 12, long enough to sufficiently, efficiently, and uniformly cool the surfaces thereof. Such a system is illustrated in FIG. 1, where coolant headers 20 and 22 on the upstream or entry side of stand 8(to the left in FIG. 1) and coolant headers 24, 26 on the downstream or delivery side of stand (to the right in FIG. 1) are designed to deliver to work rolls 10, 12, separate curtain walls of coolant indicated by dash-dot lines to work rolls 10, 12 which walls are approximately equal to the rolling surfaces of the rolls. These walls of coolant are of a low pressure of approximately 10 psi, and the coolant molecules are non-turbulent and coherent in that a generally uniform cross-sectional wall of coolant impinges upon the work roll regardless of the distance and/or angle of coolant headers 20, 22, 24, and 26 relative to the roll surface of work rolls 10, 12.

During the rolling of hot strip 13 the contacting surface areas of work rolls 10, 12 which are the roll bite areas absorb a substantial amount of heat existing in the strip due to the roll's direct contact with strip 13. Work rolls 10, 12 are directly contacted by back-up rolls 14, 16. In still referring to FIG. 1, headers 20, 22 on the entry side of stand 8 are angled such as to deliver a coherent curtain wall flow against a surface of top and bottom work rolls 10, 12 immediately leaving contact with their respective back-up rolls 14, 16, and in a direction towards the direction of rotation of the work rolls. This application of coolant on the entry side intensifies the cooling action of the surface of work rolls 10, 12.

For top work roll 10, this impingement of coolant flow is in a fourth quadrant and for the bottom roll 12, impingement is in the third quadrant, which quadrants are so designated with reference to a plane divided by the reference axes x-y in a Cartensian coordinate system and counting clockwise from the area in which both x-y coordinates are positive. The coolant flow tangentially contacts under a low pressure work rolls 10, 12 in their above mentioned fourth and third quadrant, respectively.

As strip 13 exits from between the roll bite, approximately a first quadrant of upper work roll 10 and a first quadrant of lower work roll 12 are the regions containing the maximum amount of heat, since these areas have just left contact with strip 13. As shown in FIG. 1, coolant headers 24 and 26 on the delivery side of stand 8 are positioned to deliver a coherent curtain wall tangentially along the length of work rolls 10, 12 in their first quadrants, which quadrants were defined earlier and which quadrants of work rolls 10, 12 remain in the same reference plane, however, the actual area on the roll surface changes due to the rotation of the work rolls 10, 12.

Upon the tangential impingement of the coherent curtain wall flow coextensive along the length of work rolls 10, 12, the coolant having a very high retention factor is caused to separate and flow in opposite directions in film-like form to create a cooling field substantially extensive and uniform in length, height, and thickness around an arc segment of each work roll 10, 12. For headers 24, 26 on the delivery side of the stand 8, this means that when the coolant separates, a uniform film-like flow moves downward along top work roll 10 and upward along bottom work roll 12 into the roll gap to immediately cool this critical area of work rolls 10, 12. Naturally, the opposing flow after softly contacting the rolls 10, 12, travels upwardly along top roll 10 towards the area contacting back-up roll 14, and downwardly along bottom roll 12 towards the area contacting back-up roll 16.

As for headers 20, 22 on the entry side, the coolant upon rolls 10, 12 separates into two substantially uniform film-like flows, one towards the contacting area with their respective back-up rolls and the other flow towards the rolling area. The flow towards the contacting area of the back-up roll with the work roll causes a "Puddling Effect" or an amount of coolant to accumulant thereby intensifying the cooling action on the surface of work rolls 10, 12.

As shown in FIG. 1, strip 13 travels between strip guides 28 and 30 lacated on both sides of stand 8. The positioning of these strip guides makes it difficult in many applications to mount coolant headers 20, 22, 24 and 26 any closer to work rolls 10, 12 than as shown, but the design of coolant headers 20–26 is such that they are easily mounted to strip guides 28, 30 through suitable fastening means (not shown) and because of this limitation the type and controlled flow pattern of the present invention is of great advantage.

Figure 2:
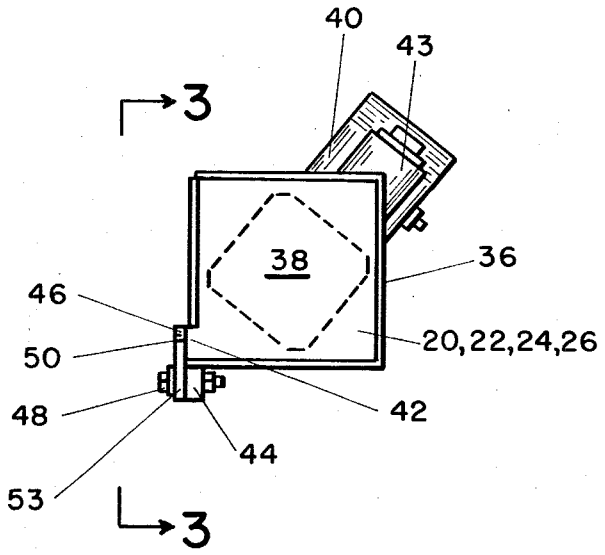
FIG. 2 is a front view of one of the headers incorporating the present invention.
Figure 3:
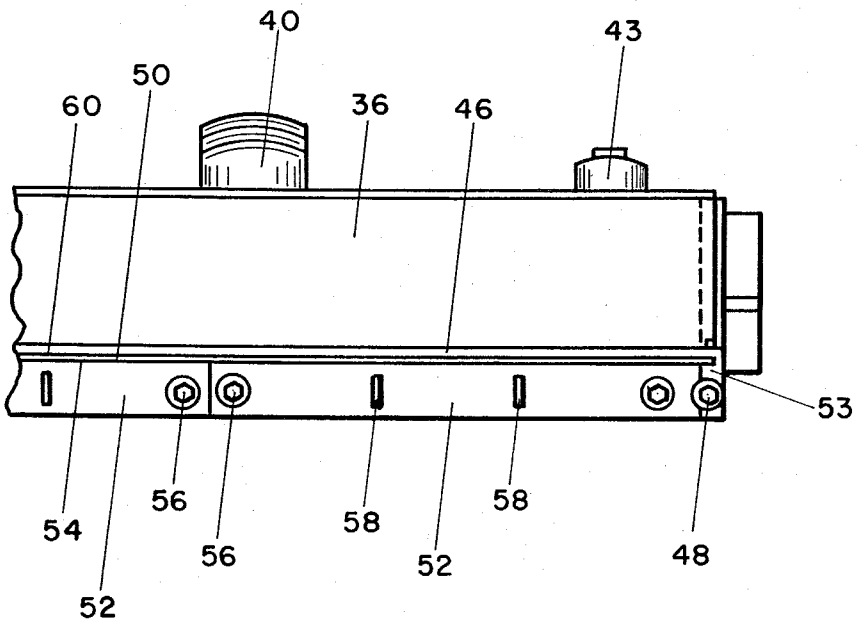
FIG. 3 is a partial, elevational view taken along lines 3—3 of FIG. 2.

The design and construction of each header 20, 22, 24, and 26, is shown in FIGS. 2 and 3 where each header is generally a rectangular container 36 having a chamber 38 for receiving coolant, coolant inlets 40, one of which is shown in FIG. 3 and outlet 42. Excess coolant is carried away through drains 43, one of which is shown in FIG. 3.

Outlet 42 extends the length of header 20, 22, 24 and 26, where only a portion of its length is shown in FIG. 3, but it is to be understood that the other portion of each header 20, 22, 24, 26 is similar to that shown in FIG. 3. Mounted on the lower portion of container 36 adjacent to outlet 42 is member 44 which runs parallel to and extends the length of container 36. This is provided so that plate member 46 can be affixed by nut and bolt assembly 48 to container 36 at outlet opening 42 to form a continuous elongated slot 50 at outlet opening 42. Several elongated members 52 are arranged in abutting relationship to fit between leg section 53 (one of which is only shown) of plate member 46, which arrangement forms a continuous longitudinal edge 54.

These members 52 are affixed to member 44 through several nut-bolt assemblies 56 extending through slots 58 and cooperates with longitudinal edge 60 of plate member 46 to form the continuous elongated slot 50. The contour of continuous longitudinal edge 54 of elongated members 52 is such that a tapering effect can be obtained from the middle section outwardly to opposing ends of slot 50 where the middle portion of slot 50 has a wider spacing than the opposed ends. This is particularly shown in FIG. 3, where the opposing ends are formed by the furthest portions 52 of slot 50, one portion 52 located to the right of FIG. 3, and which is to be understood, one portion 52 located to the left in FIG. 3 if coolant headers 20, 22, 24, 26 were extended to be fully represented in FIG. 3. Central member 52 can be positioned furthest away from longitudinal edge 60 to give this widest spacing, and hence, maximum cooling, and naturally, the outer members 52 located on opposing sides of central member 52, can be positioned to give the narrowest spacing, and hence, a tapering cooling effect in which the outer ends can be controlled to give the minimum or no cooling effect.

Adjustment of slot or opening 50 is done through movement of members 52 towards or away from longitudinal edge 60, which movement is easily accomplished due to slots 58 in each member 52. This adjusting of the spacing of opening 50 does not interfere with the integrity of the coherent curtain wall flow, but only varies the transverse thickness of the flow.

The location and positioning of each header 20, 22, 24, 26 is selected to be as close to the roll bite in the case of headers 24, 26 and to the area between the back-up roll and its respective work roll as in the case of headers 20, 22 as is feasible without interfering with any of the other apparatuses necessary for the rolling operation, such as strip deflector rolls, strip cooling means, etc. As shown, and as mentioned previously, headers 20, 22, 24, 26 are mounted to strip guides 28, 30. Regardless of the distance between the work rolls 10, 12 and headers 20–26, a flow of coherent coolant is continually discharged to quickly and efficiently remove a substantial amount of heat transmitted to the segment of work rolls successively leaving their contacting areas. This becomes important when it is realized that after many hours of production rolling, the outer surface of work rolls 10, 12 is worn down to where the surface has to be reground, resulting in a lesser diameter for each work roll 10, 12. This regrinding is done several times before the life of the roll is depleted, however, headers 20–26 can remain in their initial operating position without being adjusted to accommodate this varying distance between the work rolls and headers 20–26, and without deviating from the cooling efficiency of the roll surface obtained for the original diameter of work rolls 10, 12. During roll changing, strip guides 28, 30 are moved away from work rolls 10, 12 and a new pair of work rolls are inserted in the stand 8, and the guides brought back to their former positioning with headers 20–26 angled in a predetermined positioning suitable to direct the coolant flow against the surface of work rolls 10, 12.

Referring again to tapered slot 50, this opening outline of slot is such that it is adjusted to accommodate the camber of a roll's barrel when the crown is thermally expanded in the rolling process. The present invention is being described in the environment of a hot mill. Work rolls 10, 12 have a mechanical camber and the heat of the strip causes an increase in this camber resulting in thermal camber. Slot 50 is such that the flow of coolant is corrective to the extent the mechanical camber is maintained but the thermal camber is eliminated. This coolant flow pattern is imparted on the roll surface which among the many other characteristics of curtain wall flow contribute to obtain the optimum cooling thereof, which optimum cooling effect would be represented by a parabolic curve if cooling vs. roll length is plotted on a graph.

In such a graph, the greatest cooling rate can be controlled to occur in the center of work rolls 10, 12 where the greatest amount of heat is absorbed, and would taper from the center to the opposite ends thereof. This parabolic cooling curve parallels the known distribution of temperature along the roll barrel, and therefore the great significance of the uniform and optimum cooling effect of the subject invention can be greatly envisioned.

The transverse dimension of strip 13 dictates the extent of the heat pattern transmitted along the other surface of the barrel for work rolls 10, 12, i.e. if the rolling mill is rolling a minimum width strip, than this minimum heat area is transferred to work rolls 10, 12 and correlatively, this holds true for the maximum width strip.

Adjustable slot or opening 50 of headers 20, 22, 24, 26 are made to accomodate the varying width strip. Members 52 can be positioned to create a length slot corresponding to the width strip being rolled, which, in effect varies the flow rate along the length of slot 50.

At all times the center opening may be spaced at its maximum operated positioning. As a minimum width strip is being rolled heat is transmitted to an area of the roll body equal to the width of the strip. In this case, the two outer members 52 of tapered slot 50 of headers 20–26 may be brought towards longitudinal edge 60 a distance such that only the required coolant flow rate is delivered through central member 52. If a maximum width strip is being rolled heat is transmitted to a greater area along the roll barrel. In this instance, the two outer members 52 can be positioned in their maximum spacing away from longitudinal edge 60 to permit an even distribution of the coolant flow rate along the entire length of slot 50. This positioning of members 52 to vary the flow rate along the slot's length translates into varying parabolic cooling curves, and as mentioned previously, closely simulates the desired parabolic cooling across the roll barrel. As already alluded to, low pressure coolant is delivered to headers 20–26 through inlets 40, into chamber 38, and through outlet 42. Any excess volume is drained through drain lines 43.

The coolant for rolling hot steel strip generally is water, but it is to be noted that other base liquids can be used for treatment of a roll, or the like, in other mills and in non-mill applications. Also, even though the subject invention is described in the environment of a four high rolling mill for rolling hot steel strip, the scope of the subject invention encompasses the rolling of ferrous and also non-ferrous metals such as aluminum and mechanical aplications where heat is to be removed from the apparatus for cold work thereof and where the invention can be utilized for applying rolling and cooling lubricants.

Even though headers 20–26 are shown in the figures to have only one nozzle outlet for delivering curtain wall flow these headers 20–26 can also be designed with two or more elongated nozzles each delivering a curtain wall flow. Such flows can be regulated to deliver a desired percentage of the flow rate of coolant.

From the foregoing, it can be appreciated that not only is optimum cooling of a section of a face of a work roll achieved, but in view of this optimize cooling of the entire rolling system including the components of stand 8 is achieved by the providing of headers 20, 22, 24, and 26 and their particular positioning relative to the critical areas of work rolls 10, 12 in their rolling of strip 13. Due to the integrity of the coherent curtain wall flow, the entire face or outer peripheral surface of each work roll 10, 12 is uniformly cooled. Also, because the coolant flow is lowpressure, non-turbulent, and coherent its impingement upon the roll surface is controlled and restricted to flow only upon the roll instead of entering the bearings as is the case with high pressure flows.

In accordance with the patent statutes I have explained the principals and operation of my invention and have illustrated and described what I consider to represent the best embodiment thereof.

I claim:

1. A method for the treatment of a rotating work roll of a rolling mill or the like for working a workpiece wherein the roll absorbs heat during the rolling process due to its contact with an external element, such as said workpiece, the steps comprising:

creating at least one wall of treatment medium by a medium discharge header means, said wall being in the form of a non-turbulent low pressure coherent curtain wall applied continuously across at least a selected axial portion of the face of said roll, controlling the placement of said at least one coherent curtain wall so that said medium is caused to be uniformly delivered to said roll substantially coextensive with said selected portion, causing said wall to be directed against said portion from a position where the header means is spaced from said portion and is located at a point remote from where said external element leaves contact with said roll, and wherein because of the inherent nature of the wall it maintains its wall-like form from the time it leaves the header means until it first contacts the roll at said portion without any assistance from any physical medium directing means, and causing said coherent curtain upon impingement to separate into two opposed film-like fields around and on said face of said roll, which said fields freely adhere to said face for a certain length of time without assistance from any physical film-forming and retaining means, said one film-like field travelling in a direction opposite to that of said rotation of said work roll toward the general region where said external element leaves contact with said roll to thereby uniformly treat the peripheral surface of said roll between said initial point of application of said medium and said contact area of said external element.

2. A method according to claim 1, wherein the absorbed heat results in cambering or increasing the camber of said work roll along its length, and wherein upon said deliverance and impingement the thickness of said applied medium transversely in cross-section closely resembles the configuration of said camber in said work roll, and wherein said external element is a heated piece of material whose transverse dimension may differ from that of a previously worked piece of material, the steps further comprising:

varying said camber configuration of said applied medium in a manner to accommodate the transverse dimension of said piece of material to the extent an appreciable controlled amount of said heat is removed from said work roll.

3. A method for the treatment of opposed work rolls in a rolling mill or the like, for rolling heated strip in between the roll gap formed by said work rolls, wherein said work rolls absorb heat during the rolling of said strip and have a downstream side relative to said mill, the steps comprising:

creating at least one wall of treatment medium for each said work roll by a medium discharge header means, said wall being in the form of a non-turbulent low pressure coherent curtain wall applied continuously across at least a selected axial portion of the face of said work roll on the downstream side thereof, controlling the placement of said each at least one coherent curtain wall for said each work roll so that said medium is caused to be uniformly delivered to said each work roll substantially coextensive with its said selected portion, causing said wall to be directed against said portion from a position where the header means is spaced from said portion having no contact therewith and located at a point remote from where said heated strip leaves contact with said rolls in said gap, and wherein because of the inherent nature of the wall it maintains its wall-like form from the time it leaves the header means until it first contacts the work roll at said portion without any assistance from any physical medium directing means, and causing said each at least one coherent curtain upon impingement to create a film-like field around and on said face of said each work roll, which said fieldfreely adheres to said face for a certain length of time without assistance from any physical film-forming and retaining means, said film-like field of said each work roll travelling in a direction opposite to that of said rotation of said work roll carrying said film-like field in the general region toward said roll gap to uniformly treat the peripheral surface of said work roll between said initial point of application of said medium and said contact area of said work rolls and said strip.

4. A method according to claim 3, wherein said each work roll contacts a respective back-up roll during the rolling process, and wherein said work-rolls have an upstream side relative to said mill, the steps further comprising:

creating at least one wall of treatment medium for each said work roll by a medium discharge header means, said wall being in the form of a non-turbulent low pressure coherent curtain wall applied continuously across at least a selected axial portion of the face of said work roll on the upstream side thereof, controlling the placement of said each at least one coherent curtain wall for said each work roll so that said medium on said upstream side is caused to be uniformly delivered to said each work roll substantially coextensive with its said selected portion, causing said wall to be directed against said portion from a position where the header means is spaced from said portion having no contact therewith and located at a point remote from where said each work roll leaves contact with its said respective back-up roll, and wherein because of the inherent nature of the wall it maintains its wall-like form from the time it leaves the header means until it first contacts the work roll at said portion without any assistance from any physical medium directing and retaining means, and causing said each at least one coherent curtain upon impingement to create a film-like field around and on said face of said each work roll, which said field freely adheres to said face for a certain length of time without assistance from any physical film-forming and retaining means, said film-like field of said each work roll travelling in a direction opposite to that of said rotation of said work roll carrying said film-like field in the general region where said work roll contacts its respective back-up roll to uniformly treat the peripheral surface of said work roll between said initial point of application of said medium and said contact area of said work rolls with their said respective back-up roll.

5. A method of cooling according to claim 4, wherein the absorbed heat results in cambering or increasing the natural camber in said work rolls along their length, and wherein upon said deliverance and said impingement the thickness of said applied curtain of medium transversely in cross section closely resembles the configuration of said camber in said work rolls, and wherein said heated strip has a transverse dimension which may differ from that of a previously rolled heated strip, the steps further comprising:

varying said configuration of said applied medium in a manner to accommodate the transverse dimension of said heated strip to the extent an appreciable, controlled amount of said heat is removed from said work rolls.

6. In an arrangement for treating opposed rotating work rolls of a rolling mill or the like for rolling heated strip between the roll gap formed by said work rolls, wherein the face or outer surface of the work rolls absorb heat during the rolling process due to their contact with said strip and with a respective back-up roll, and comprising:

a plurality of medium header means located on both said upstream and downstream sides and associated with said each work roll for creating at least one wall of treatment medium, said wall being in the form of a non-turbulent low pressure coherent curtain wall applied continuously across at least a selected axial portion of said face of said work rolls, and means for controlling the placement of said medium header means so that said medium is caused to be uniformly delivered to said work rolls substantially coextensive with said selected portion, said medium header means further including means for causing said wall to be directed against said portion from a position where said header means is spaced from said portion having no contact therewith and located at a point remote from where said strip leaves contact with said work rolls, and wherein because of the inherent nature of said curtain wall it maintains its wall-like form from the time it leaves said header means until it first contacts its respective work roll at said portion without any assistance from any physical medium directing means, and for causing said coherent curtain upon impingement to separate into two opposed film-like fields around and on said face of said work roll, which said fields freely adhere to said face for a certain length of time without any assistance from any physical film-forming and retaining means, one film-like field travelling in a direction opposite to that of said rotation of said work roll toward the general region where said strip leaves contact with said work rolls to thereby uniformly treat the peripheral surface of said work rolls between said initial point of application of said medium and said contact area of said strip and toward the general region where said work rolls contact their respective back-up roll to uniformly treat the peripheral surface of said work rolls between said initial point of application of said medium and said contact area of said work rolls with their said respective back-up rolls.

7. In an arrangement according to claim 6 wherein said work rolls have a camber and the absorbed heat increases the extent of said camber along their length, and said header means consists of at least one elongated nozzle arranged parallel to the length of said work rolls, said at least one nozzle having an adjustable medium outlet means comprising a plurality of movable elongated members and a plate member having a longitudinal edge cooperating with said elongated members in a manner that the transverse cross-sectional thickness of said applied medium closely resembles the configuration of said camber in said work rolls.

8. In an arrangement according to claim 7, wherein the transverse dimension of said strip may differ from a previously worked strip, and wherein said header means further comprises:

means for adjusting said movement of said elongated members of said medium outlet means of at least one nozzle relative to said longitudinal edge of said plate member to accommodate said traverse dimension of said strip to the extent an appreciable controlled amount of heat is always removed from said work rolls.

9. In an arrangement according to claim 6, wherein said at least one elongated nozzle of said each header means is further constructed and arranged to produce an enveloping coverage of said medium in a manner said coherent curtain is uniform in extent and thickness over the entire said surface of each said work roll.

10. In an arrangement according to claim 7, further comprising a retractable guiding mechanism on both said upstream and downstream sides of said mill for guiding said strip traveling in said roll gap, and wherein said plurality of header means consists of at least two headers for said each work roll, which headers are mounted on said guiding mechanisms and are retractable therewith away from said roll gap in preparation for the work roll changing procedure.

11. In an arrangement according to claim 10, wherein said at least one elongated nozzle of said each header consists of a slot wherein said plate member forms a straight wall and said movable members consist of at least three separate adjustable sections arranged relative to each other and said plate member to form a cross-sectional tapering effect extending from said center to each end of said slot.

* * * * *